United States Patent [19]

Wieder

[11] Patent Number: 4,915,214

[45] Date of Patent: Apr. 10, 1990

[54] HOLDER FOR NUMISMATIC ITEMS

[76] Inventor: Horst K. Wieder, 1002 S. 12th St., Watertown, Wis. 53904

[21] Appl. No.: 265,058

[22] Filed: Oct. 31, 1988

[51] Int. Cl.[4] ..... B65D 25/54

[52] U.S. Cl. ..... 206/0.82; 206/459

[58] Field of Search ..... 206/0.8, 0.81, 0.82, 206/0.83, 0.84, 45.34, 459; 220/82 A

[56] References Cited

U.S. PATENT DOCUMENTS

| | | | |
|---|---|---|---|
| 3,139,977 | 7/1964 | Burdick | 206/0.83 |
| 3,229,809 | 1/1966 | Spadaro | 206/0.82 |
| 3,624,832 | 11/1971 | Dunn | 206/0.83 |
| 4,320,831 | 3/1982 | Szabo . | |
| 4,364,472 | 12/1982 | Waldmeier | 206/45.34 |
| 4,378,876 | 4/1983 | Szabo et al. | 206/0.82 |
| 4,385,688 | 5/1983 | Grant | 206/0.82 |
| 4,399,910 | 8/1983 | Gutentag | 206/0.82 |
| 4,425,997 | 1/1984 | Grant | 206/0.82 |

FOREIGN PATENT DOCUMENTS

| | | | |
|---|---|---|---|
| 1400076 | 7/1975 | United Kingdom | 206/0.82 |

OTHER PUBLICATIONS

Catalog brochure for Capital Plastics, Inc., Catalog 85, 1984/1986.

*Primary Examiner*—William Price
*Attorney, Agent, or Firm*—Lathrop & Clark

[57] ABSTRACT

A holder (10) has a top housing (12) and a bottom housing (14) which encloses a numismatic item (24) for protection and display. The top housing (12) has an interior surface (28), an exterior surface (30), and edges (32, 34, 36, 38). The bottom housing (14) has an interior surface (46), an exterior surface (48), and edges (50, 52, 54, 56). Each of the edges (32, 34, 36, 38) of the top housing (12) has an underlapping finger (40) that extends from the interior surface (28) and that interlocks with an overlapping finger (58) that extends from the interior surface (46) of the edges (50, 52, 54, 56) of the bottom housing (14) when the housings (12, 14) are pressed together. The fingers (40, 58) have respective barbs (42, 60) which engage with one another when the housings (12, 24) are pressed together to seal and confine the numismatic item (24) in a chamber (86) formed between a first coin window (16) located in the top housing (12) and a second coin window (18) located in the bottom housing (14). A label (26) may be similarly enclosed in a chamber (88) formed between a first label window (20) and a second label window (22). An elastomeric ring (80) of optional size may be used to enclose a numismatic item (24) that is smaller than the chamber (86).

14 Claims, 4 Drawing Sheets

HOLDER FOR NUMISMATIC ITEMS

FIELD OF THE INVENTION

This invention relates to holders which display and protect numismatic items.

BACKGROUND OF THE INVENTION

Coin collectors, coin dealers, and mints commonly use some type of plastic holder to mount, protect, and display their coins, medals, and other collectibles. These holders are often separable at a seam that divides two housings, and there is therefore some risk that the numismatic item may be removed or tampered with, or that the coin may be dislodged from its holder by routine handling or storage. In other cases, the holder is made to be tamper-proof by the sealing together of the housings by ultrasonic or adhesive sealing processes. While these processes may be available to the mints and the larger dealers, they are not ordinarily available to those who maintain smaller inventories and coin collections. The result is that many numismatic items may not be adequately protected in that they may be dislodged from their holders, or tampered with, as by a child.

In addition, desired labeling of the numismatic items is not readily accomplished. The holders are plastic and cannot easily be written upon. Desired inscriptions are therefore easily wiped away, even if such wiping is inadvertent. Labeling may be accomplished by the adhesion of a tape and marking thereupon, but the labeling is lost if the marking gets rubbed off of the tape or if the tape gets rubbed off of the holder.

Ideally, the holders confine the numismatic items in a chamber, the chamber being dimensioned to a tolerance that is just large enough to hold the numismatic item. Typically, the holders are therefore molded to have chamber sizes which are adaptable to standard coin sizes, e.g. U.S. dollar, quarter, dime, etc. However, if one has a coin which is foreign currency or is of a size no longer minted and does not match the standard coin sizes, or if one does not have a holder with a large enough chamber, the numismatic item will slide within the confines of the chamber. Such sliding is aesthetically unpleasing and may result in scratching of the chamber, thereby clouding the display of the numismatic item.

SUMMARY OF THE INVENTION

In accordance with the present invention, a holder for numismatic items is disclosed having two housings that mate and lock when pressed together, enclosing a numismatic item in a chamber formed within the housings. The holder has windows in each of the housings so that both the obverse and reverse sides of the numismatic item are displayed when the housings have been pressed together. The housings are locked together by fingers located on the housings that interlock when pressed together to create a tamper-proof fit. A ring is included in the holder to confine numismatic items that are smaller in size than the size of the chamber. The incorporation of the ring prevents items from sliding within the chamber.

The holder has a second set of windows that may be used to display a two-sided label. The label is enclosed in a second chamber formed within the housings, and is therefore, marked in a manner that cannot be wiped or rubbed off.

The aesthetic appearance of the numismatic item is highlighted by contrasting the windows from the remainder of the housing. While the windows are transparent, the remainder of the housing is opaque.

Further objects, features, and advantages of the invention will be apparent from the following detailed description taken in conjunction with the accompanying drawings.

DESCRIPTION OF THE PREFERRED EMBODIMENT

Figure 1:
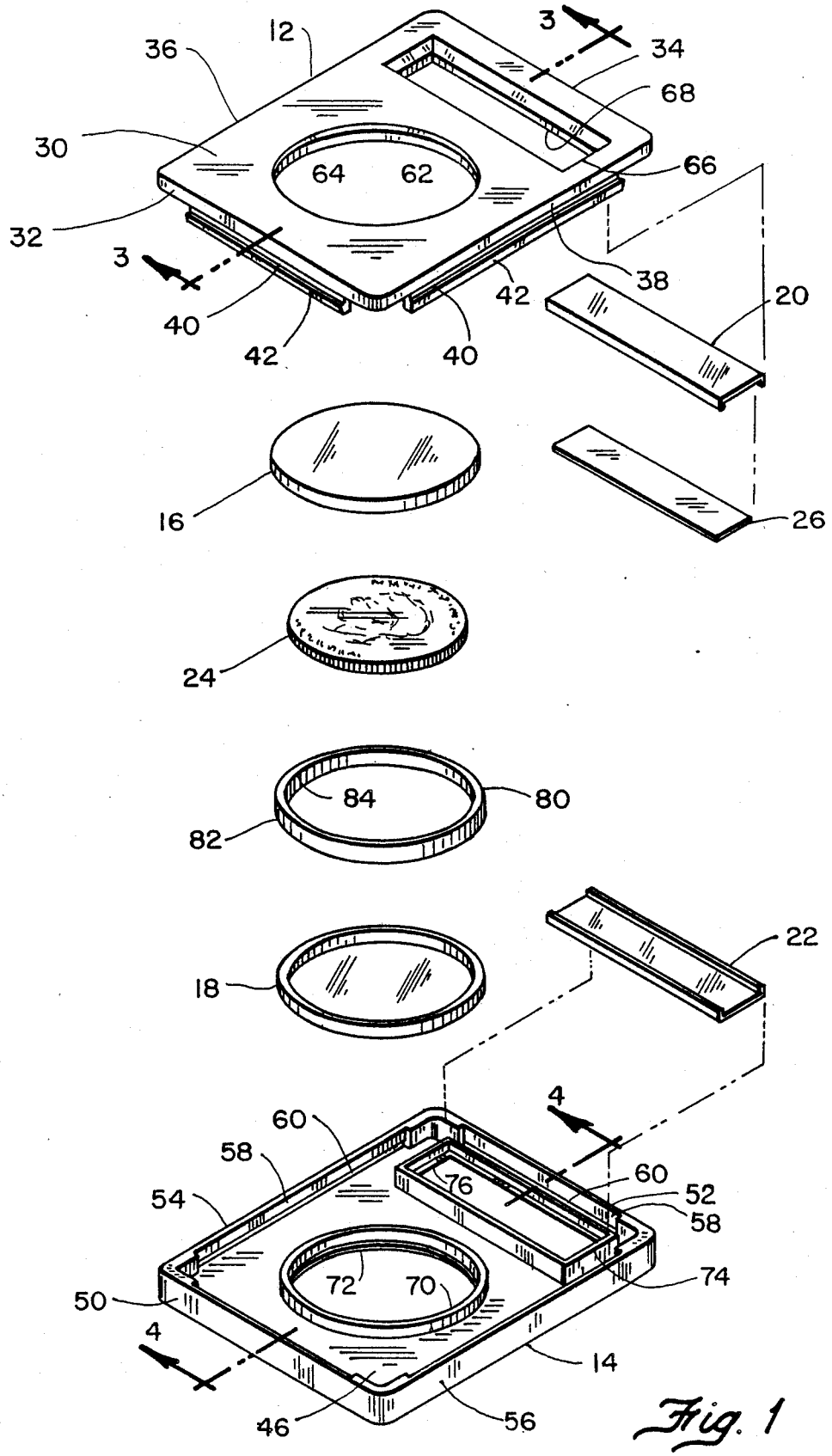
FIG. 1 is a exploded perspective view of the holder for numismatic items showing the bottom and top housings separated from each other.
Figure 2:
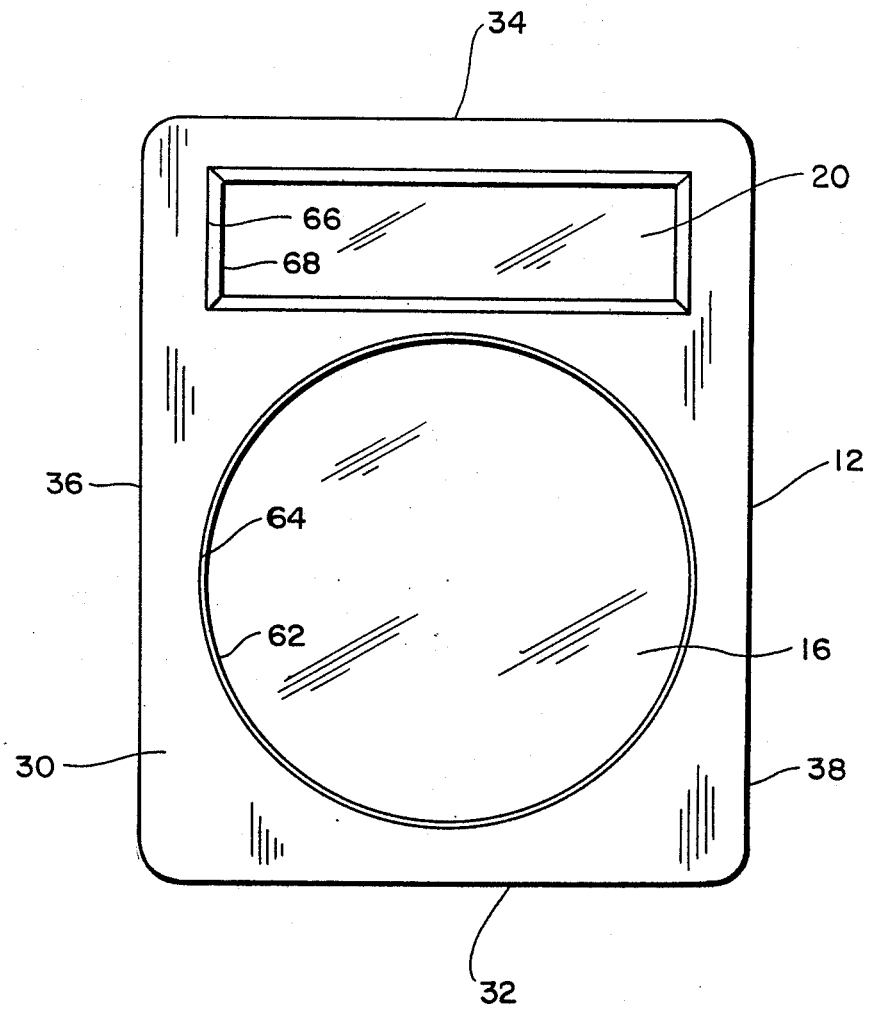
FIG. 2 is a front, exterior view of the top housing.
Figure 3:
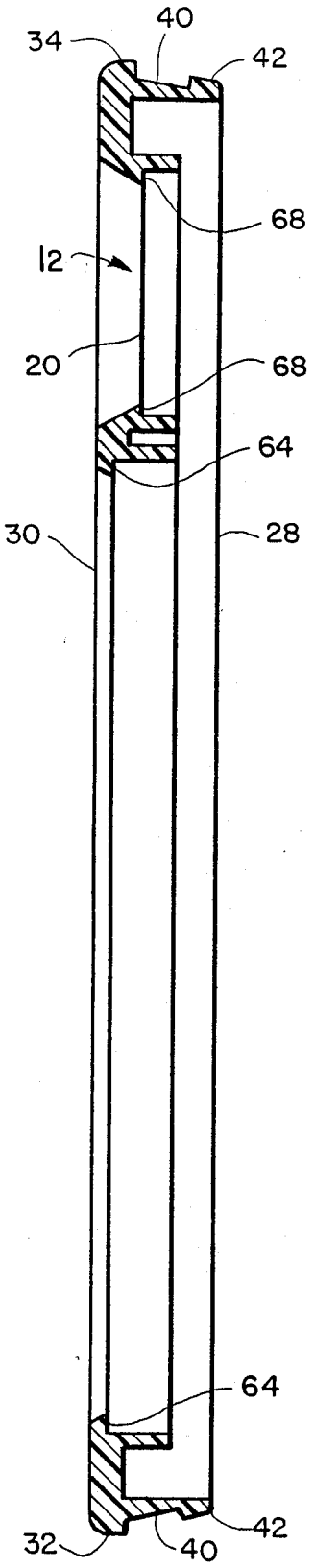
FIG. 3 is a cross-section of the top housing taken along line 3—3 of FIG. 1.

With reference to the drawings, a holder for numismatic items such as coins, medals, or the like, in accordance with the present invention is shown at 10 in FIG. 1. FIG. 1 is an exploded perspective view of the invention, the holder 10 being principally comprised of a top housing 12, a bottom housing 14, a first coin window 16, a second coin window 18, a first label window 20, and a second label window 22. The top housing 12 and the bottom housing 14 may be pressed together and interlocked, serving to encase a numismatic item 24 between the first coin window 16 and the second coin window 18. The first coin window 16, the numismatic item 24, and the second coin window 18 are sandwiched in alignment when the top housing 12 and the bottom housing 14 are pressed together. A label 26 may also be encased between the first label window 20 and the second label window 22 when the top housing 12 and the bottom housing 14 are pressed together.

Figure 4:
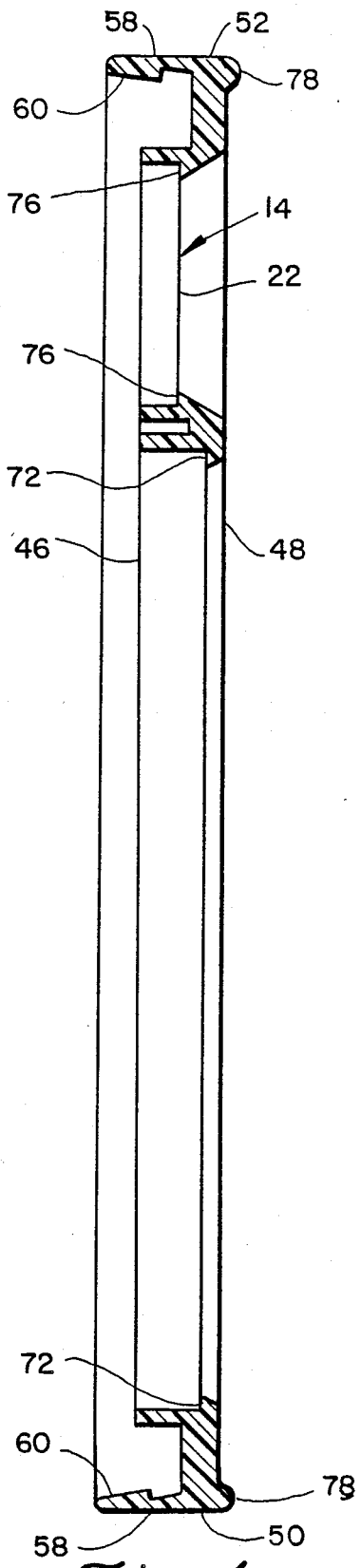
FIG. 4 is a cross-section of the bottom housing taken along line 4—4 of FIG. 1.
Figure 5:
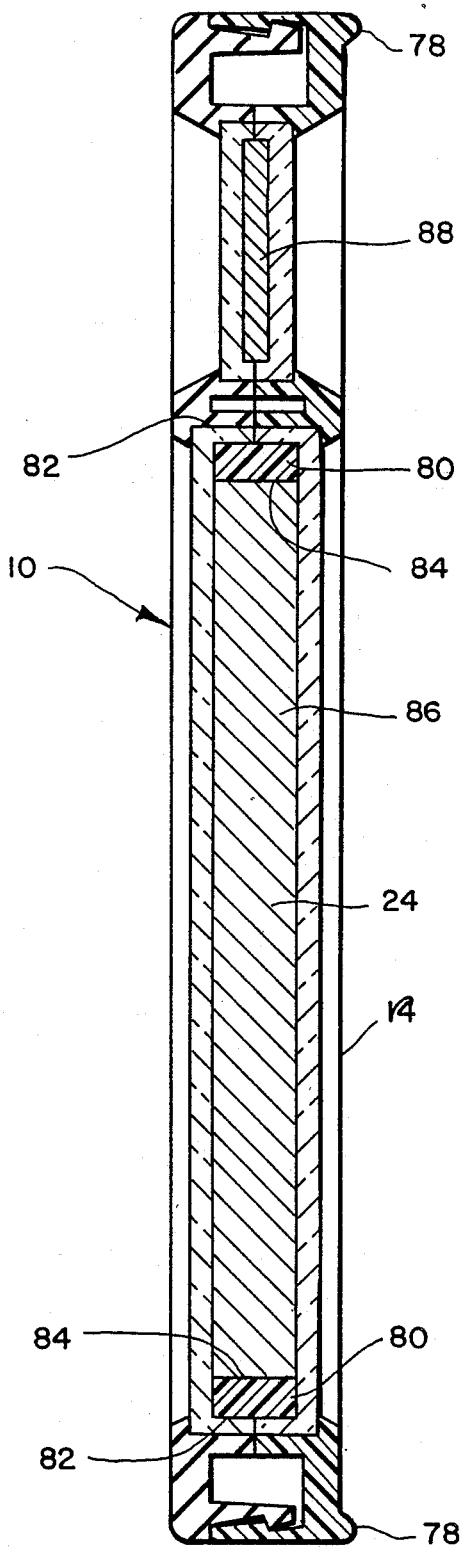
FIG. 5 is a cross-section of the top and bottom housings as shown in FIGS. 3 and 4 in assembled relation to form the holder for numismatic items, a numismatic item being contained in a chamber formed between the housings.

The top housing 12 is substantially rectangular, having an interior surface 28 and exterior surface 30, opposing edges 32 and 34 and opposing edges 36 and 38. Each of the edges 32, 34, 36, and 38 have an underlapping finger 40 extending from the interior surface 28 and running across its length, the underlapping fingers 40 having a barb 42 extending therefrom. The bottom housing 14 is also substantially rectangular, having an interior surface 46, and exterior surface 48, opposing edges 50 and 52, and opposing edges 54 and 56. Each of the edges 50, 52, 54, and 56 have an overlapping finger 58 running across its length, the overlapping fingers 58 having a barb 60 extending therefrom. The top housing 12 has a circular hole 62 sized so that the first coin window 16 may fit within the circular hole 62. The circular hole 62 has a collar 64 extending inward from within the circumference of the circular hole 62 so that the first coin window 16 may be inserted within the circular hole 62 from the interior side (i.e. the side of the interior surface 28) and be seated against the collar 64. The top housing 12 also has a rectangular aperture 66. The rectangular aperture 66 has a ledge 68 extending inward from within the boundaries of the rectangular aperture 66 so that the first label window 20 may be inserted within the rectangular aperture 66 from the interior side (i.e. the side of the interior surface 28) and be seated against the ledge 68. The bottom housing 14 has a circular hole 70 sized so that the second coin window 18 may fit within the circular hole 70. The circular hole 70 has a collar 72 extending inward from within the circumference of the circular hole 70 so that the second coin window 18 may be inserted within the circular hole 70 from the interior side (i.e. the side of the interior surface 46) and be seated against the collar 72. The bottom housing 14 also has a rectangular aperture 74 sized so that the second label window 22 may fit within the rectangular aperture 74. The rectangular aperture 74 has a ledge 76 extending inward from within the boundaries of the rectangular aperture 74 so that the second label window 22 may be inserted within the rectangular aperture 74 from the interior side (i.e. the side of the interior surface 46) and be seated against the ledge 76. The bottom housing 14 has stacking tabs 78 that run along the length of the edges 50 and 52 on the exterior surface 48 that are best shown in FIGS. 4 and 5. For aesthetic reasons, the housings 12 and 14 are made opaque; the windows 16, 18, 20, and 22 are transparent. The contrast serves to highlight the featured numismatic item 16 as displayed through the windows.

The holder for numismatic items 10 incorporates an elastomeric ring 80 having an outside diameter 82 that fits within the circular holes 62 and 70 and an inside dimension 84 that is sized according to the outside dimensions of the numismatic item 24 that is to be displayed in the holder 10. The inside dimension 84 of the elastomeric ring 80 will vary depending upon the size and shape of the numismatic item 24. It should be apparent that the inside dimension 84 may be of different diameters, or it may be rectangular, polygonal, or some other shape. The elastomeric ring 80 thus bounds the outside dimensions of the numismatic item 24 to confine the numismatic item 24 in place.

In the assembly of the holder 10, the numismatic item 24 is inserted into the elastomeric ring 80. The assembly of the numismatic item 24 and the elastomeric ring 80 is sandwiched between the first coin window 16 and the second coin window second coin window 18. The label 26 is sandwiched between the first label window 20 and the second label window 22. The numismatic item 24, the elastomeric ring 80, and the coin windows 16 and 18 are inserted into the circular hole 70 of the bottom housing 14, the second coin window 18 seating against the collar 72. The label 26 and the label windows 20 and 22 are inserted into the rectangular aperture 74, the second label window 22 seating against the ledge 76. When the second coin window 18, the elastomeric ring 80, and the first coin window 16 are positioned in the circular hole 70 and are in alignment, and when the second label window 20 are positioned in the rectangular aperture 74 and are in alignment, the two housings 12 and 14 may then be pressed together, closing the interior surface 28 of the top housing 12 against the interior surface 46 of the bottom housing 14. The two housings 12 and 14 are pressed together so that the overhanging fingers 40 of the top housing 12 and the underhanging fingers 58 of the bottom housing 14 interlock with each other, as shown in FIG. 5. In the interlocking of the fingers 40 and 58, the downward barbs 42 and upward barbs 60 engage with each other. When the fingers 40 and 58 are interlocked, the elastomeric ring 80 holds the numismatic item 24 in position and seals the numismatic item 24 via a preload against the coin windows 16 and 18. The preload of the elastomeric ring 80 maintains the seating engagement of the first coin window 16 against the collar 64 and the second coin window 18 against the collar 72. A first chamber 86 bounded by the coin windows 16 and 18, and by the inside dimension 84 of the elastomeric ring 80 is thus formed in which the numismatic item 24 is held and displayed. A second chamber 88 is formed between the label windows 20 and 22 in which the label 26 is held and displayed. The obverse and reverse sides of the numismatic item 24 and the label 26, are displayed and protected by the windows 16, 18, 20, and 22.

It should be apparent from the foregoing that the assembly orientation may be reversed i.e., the numismatic item 24, the elastomeric ring 80, and the coin windows 16 and 18 may be inserted into the circular hole 62 of the top housing, the first coin window 16 seating against the collar 64. The label 26 and the label windows 20 and 22 may be inserted into the rectangular aperture 66, the first label window 20 seating against the ledge 68. The housings 12 and 14 may then be pressed together in the aforementioned fashion.

The stacking tabs 78 have two functions as applied to the assembled holder 10. First, when the holder 10 is laid flat upon a table or other flat surface, a gap is formed beneath the exterior surface 48 of the bottom housing 14 which facilitates grasping of the holder 10. Second, when multiple holders 10 are stacked with the same orientation, the stacking tabs 78 will nest against the edges 32 and 34 of the top housing 12 and prevent the holders 10 from sliding apart. The stacking tabs 78 are shallow enough to allow easy removal of the individual holders 10 from a storage box having the holders 10 stored in a stacked, vertical arrangement.

It is understood that the invention is not confined to the particular construction and arrangement of parts herein illustrated and described, but embraces such modified forms thereof as come within the scope of the following claims.

What is claimed is:

1. A holder for protecting and displaying a numismatic item having two opposing sides, the holder comprising:

(a) a top housing having an interior surface and an exterior surface, one side of the numismatic item being viewable from the exterior surface of the top housing through a first window located in the top housing;

(b) a bottom housing having an interior surface and an exterior surface the opposing side of the numismatic item being viewable from the exterior surface of the bottom housing through a second window located in the bottom housing;

(c) a finger on the interior surface of the top housing;

(d) a finger on the interior surface of the bottom housing which interlocks with the finger on the interior surface of the top housing to seal and confine the numismatic item in a chamber formed between the first and the second windows when the top and bottom housings are pressed together; and, (e) an additional window located in each of the housings between which a label may be sealed and confined, the label being viewable from the exterior surface of at least one of the housings.

2. A holder for protecting and displaying a numismatic item having two opposing sides, the holder comprising:

(a) a top housing having an interior surface and an exterior surface, one side of the numismatic item being viewable from the exterior surface of the top housing through a first window located in the top housing;

(b) a bottom housing having an interior surface and an exterior surface the opposing side of the numismatic item being viewable from the exterior surface of the bottom housing through a second window located in the bottom housing;

(c) a finger on the interior surface of the top housing; and (d) a finger on the interior surface of the bottom housing which interlocks with the finger on the interior surface of the top housing to seal and confine the numismatic item in a chamber formed between the first and the second windows when the top and bottom housings are pressed together, wherein the top housing has a circular hole and a collar that extends inward from within the circumference of the circular hole of the top housing, the first window being sized to fit within the circular hole of the top housing and seat against the collar of the circular hole of the top housing, and wherein the bottom housing has a circular hole and a collar that extends inward from within the circumference of the circular hole of the bottom housing, the second window being sized to fit within the circular hole of the bottom housing and seat against the collar of the circular hole of the top housing.

3. A holder for protecting and displaying a numismatic item having two opposing sides, the holder comprising:

(a) a top housing having an interior surface, an exterior surface, a circular hole that communicates between the interior surface and the exterior surface, and a collar that extends inward from within the circumference of the hole of the top housing;

(b) a bottom housing having an interior surface, an exterior surface, a circular hole that communicates between the interior surface and the exterior surface of the top housing, and a collar that extends inward from within the circumference of the hole of the bottom housing;

(c) a first window that fits within the circular hole of the top housing and that seats against the collar of the circular hole of the top housing;

(d) a second window that fits within the circular hole of the bottom housing and that seats against the collar of the circular hole of the bottom housing;

(e) a finger on the interior surface of the top housing; and (f) a finger on the interior surface of the bottom housing which interlocks with the finger on the interior surface of the top housing to seal and confine the numismatic item in a chamber formed between the first and the second windows when the top and bottom housings are pressed together.

4. The holder of claim 3 wherein the finger of one of the housings is an underlapping finger and the finger of the other housing is an overlapping finger.

5. The holder of claim 4 wherein each of the fingers has a barb extending therefrom which engages a corresponding barb of the interlocking finger.

6. The holder of claim 3 wherein the housings are substantially rectangular and have four edges, each of the housings having a finger that runs alongside each of the edges on the interior surface which interlocks with a corresponding finger that runs along side an edge from the other housing.

7. The holder of claim 3 further comprising an additional window located in each of the housings between which a label may be sealed and confined, the label being viewable from the exterior surface of at least one of the housings.

8. The holder of claim 3 further comprising a ring having an inside dimension, the ring fitting within the chamber and the inside dimension being sized according to the dimensions of the numismatic item.

9. The holder of claim 8 wherein the ring is elastomeric and forms a pre-load against the first and second windows when the fingers of the top and bottom housing are interlocked.

10. The holder of claim 3 wherein the windows are transparent and the rest of the housings are opaque.

11. The holder of claim 3 wherein one of the housings has tabs which protrude from the exterior surface of the housing to facilitate grasping.

12. A kit for making a holder for protecting and displaying a numismatic item having two opposing sides, the kit comprising:

(a) a top housing having an interior surface and an exterior surface, one surface of the numismatic item being viewable from the exterior side of the top housing through a first window located in the top housing;

(b) a bottom housing having an interior surface and an exterior surface the opposing side of the numismatic item being viewable from the exterior surface of the bottom housing through a second window located in the bottom housing;

(c) a finger on the interior surface of the top housing; and (d) a finger on the interior surface of the bottom housing which interlocks with the finger on the interior side of the top housing to seal and confine the numismatic item in a chamber formed between the first and the second windows when the top and bottom housings are pressed together; and, (e) an additional window located in each of the housings between which a label may be sealed and confined, the label being viewable from the exterior surface of at least one of the housing.

13. A kit for making a holder for protecting and displaying a numismatic item having two opposing sides, the kit comprising:

(a) a top housing having an interior surface and an exterior surface, one surface of the numismatic item being viewable from the exterior side of the top housing through a first window located in the top housing;

(b) a bottom housing having an interior surface and an exterior surface the opposing side of the numismatic item being viewable from the exterior surface of the bottom housing through a second window located in the bottom housing;

(c) a finger on the interior surface of the top housing; and (d) a finger on the interior surface of the bottom housing which interlocks with the finger on the interior side of the top housing to seal and confine the numismatic item in a chamber formed between the first and the second windows when the top and bottom housings are pressed together, wherein the top housing has a circular hole and a collar that extends inward from within the circumference of the circular hole of the top housing, the first window being sized to fit within the circular hole of the top housing and seat against the collar of the circular hole of the top housing, and wherein the bottom housing has a circular hole and a collar that extends inward from within the circumference of the circular hole of the bottom housing, the second window being sized to fit within the circular hole of the bottom housing and seat against the collar of the circular hole of the top housing.

14. A kit for making a holder for protecting and displaying a numismatic item having two opposing sides, the kit comprising:

(a) a top housing having an interior surface, an exterior surface, a circular hole that communicates between the interior surface and the exterior surface, and a collar that extends inward from within the circumference of the hole of the top housing;

(b) a bottom housing having an interior surface, an exterior surface, a circular hole that communicates between the interior surface and the exterior surface of the top housing, and a collar that extends inward from within the circumference of the hole of the bottom housing;

(c) a first window that fits within the circular hole of the top housing and that seats against the collar of the circular hole of the top housing;

(d) a second window that fits within the circular hole of the bottom housing and that seats against the collar of the circular hole of the bottom housing;

(e) a finger on the interior surface of the top housing; and (f) a finger on the interior surface of the bottom housing which interlocks with the finger on the interior surface of the top housing to seal and confine the numismatic item in a chamber formed between the first and the second windows when the top and bottom housings are pressed together.

* * * * *